United States Patent [19]

Modler et al.

[11] 4,276,752

[45] Jul. 7, 1981

[54] REFRIGERATED AIR CARGO CONTAINER

[75] Inventors: Peter R. Modler, Los Angeles; Harold E. Dittmer, San Francisco; Richard L. Rose, Newark; John A. Stafsnes, San Anselmo, all of Calif.

[73] Assignee: Pax Equipment Management, Inc., San Francisco, Calif.

[21] Appl. No.: 944,869

[22] Filed: Sep. 22, 1978

[51] Int. Cl.[3] ..... F25D 3/12

[52] U.S. Cl. ..... 62/166; 62/372; 62/387; 62/418

[58] Field of Search ..... 62/166, 418, 384, 165, 62/371, 372, 384, 387

[56] References Cited

U.S. PATENT DOCUMENTS

| | | | |
|---|---|---|---|
| 222,121 | 12/1879 | Bate | 62/418 |
| 1,888,646 | 11/1932 | Weston | 62/384 |
| 1,917,866 | 7/1933 | Wood | 62/166 |
| 2,043,570 | 6/1936 | Baird | 62/384 X |
| 2,123,678 | 7/1938 | Madden | 62/387 X |
| 2,190,046 | 2/1940 | Robinson et al. | 62/384 X |
| 2,298,896 | 10/1942 | Meyer | 62/418 X |
| 2,502,192 | 3/1950 | Williamson | 62/384 X |
| 2,536,241 | 1/1951 | Williamson et al. | 62/384 X |
| 3,335,653 | 8/1967 | Heimann | 98/6 |
| 3,864,936 | 1/1974 | Frank et al. | 62/385 |

FOREIGN PATENT DOCUMENTS

| | | | |
|---|---|---|---|
| 26162 | of 1907 | United Kingdom | 62/418 |

*Primary Examiner*—William E. Wayner
*Assistant Examiner*—Harry Tanner
*Attorney, Agent, or Firm*—Limbach, Limbach & Sutton

[57] ABSTRACT

A refrigerated cargo container, comprising no moving parts, for use in transporting temperature sensitive cargoes in aircraft. The container has six insulated walls with an insulated door along part of one of the walls, preferably the container's front wall, to provide for an air-tight container when the door is closed. An insulated bunker, having an insulated wall about a portion of its outer surface and a heat exchange portion along its bottom surface, containing a coolant such as solid carbon dioxide, is located within one of the top corners of the insulated cargo container. An air inlet duct extends along the top wall of the insulated container to one side of the insulated bunker to allow warm air from the interior of the container and the cargo to flow into the inlet duct along the top wall of the container and to pass along the side and bottom of the coolant bunker where the warm air is cooled by the heat exchange portion of the bunker. A small fan driven by a small motor may be installed along the path of the air inlet duct to increase the flow of warm air to the bunker heat exchange portion. Cool air flowing from the heat exchange portion of the bunker is then passed through an output air duct, formed by a curtain, preferably an insulated curtain, passing along one of the insulated side walls of the container to circulate cool air through the interior of the container and among the cargo being transported in the container. Vapor from the coolant, for example subliming carbon dioxide, may be passed along the top of the container through one or more insulated chimneys which is either vented to the outside of the container to allow the vapor from the coolant to escape from the container or to the inside of the container to allow the vapor to be released within the container.

7 Claims, 3 Drawing Figures

REFRIGERATED AIR CARGO CONTAINER

FIELD OF THE INVENTION

This invention relates generally to a refrigerated cargo container and more particularly relates to a cargo container for transporting temperature-sensitive cargo on aircraft where the temperature within the container must be maintained within a desired temperature range for up to 72 hours regardless of the outside ambient temperatures.

BACKGROUND OF THE INVENTION

With the growing need for getting various types of temperature-sensitive cargo (such as blood plasma for human use) to various points across the country and around the world in short periods of time, there is a growing need for refrigerated air cargo containers to transport these temperature-sensitive cargoes and maintain them within a desired temperature range during their freight time. However, shipment of these temperature-sensitive commodities have not been very popular with the airlines because there has not been a reliable and effective refrigerated air cargo container for shipment of the goods. As a result of this, aircraft salespersons have not been willing to pursue the business of shipping temperature-sensitive commodities because of the risk involved in having to pay high dollar claims in the event that the shipment is lost or damaged. The refrigerated cargo industry has encountered many problems in attempting to effect a reliable and effective refrigerated container for shipment of temperature-sensitive commodities.

One of the main problems confronting the refrigerated container industry has been the problem of maintaining a reasonably uniform temperature within the container during the freight period. While temperature stability is much more important for some commodities than others, ideally a refrigerated container should maintain its contents within a ±2° F. temperature range and it is desirable that the container maintain temperatures within ±4° F. These temperature ranges should be maintained for a minimum of 36 hours when the cargo is frozen to temperatures near 0° F. prior to shipment and for a minimum of 72 hours when the cargo is near freezing, i.e. in the 32°–40° F. range. Temperature-sensitive cargoes are normally carried either at around 0° F. (for frozen beef) or just above freezing in the 32°–40° F. temperature range for most fresh produce. Some cargoes such as human blood plasma are carried in the −20° F. temperature range. Normally these temperature-sensitive cargoes are precooled to their desired temperature before they are loaded into the refrigerated container; however, many cargoes are living organisms which continue to respire and generate heat while in transit.

Another problem facing the refrigerated cargo industry is that of maximizing the amount of interior space in the container which is useful or can be used by the shipper for storing his cargo. That is, a shipper is most interested in maximizing the amount of space which he has available to him for storing his cargo, since one extra cubic foot of interior space can save a shipper from $180–$590 per year in freight charges and rental of his cargo container. Therefore, it is desirable that most of the interior of the container be available for transporting cargo rather than occupied by the refrigeration mechanism or means for cooling the cargo.

Still another problem confronting the refrigeration container industry is that of minimizing the overall weight of the container and the refrigeration means. This weight, here defined as the tare weight (container weight ± weight of refrigerating mechanism ± weight of coolant) should be maintained at a very minimum, since an extra one pound in tare weight can cost an airliner between $0.70–$1.30 in fuel costs per year (based on about 50 flights per year). Also, if the commodity is very dense so that the container shipment is weight limited, an extra one pound of tare weight could cost $25.00 in lost freight income.

Perhaps the most important problem confronting the refrigeration cargo industry has been that of effecting a reliable container. This is a most important factor since if a refrigerated container fails to transport the cargo within the desired temperature range, then the entire shipment of cargo may well be lost. Such a loss can be rather costly to both the shipper and the airline in settling claims since one load of cargo weighing around 2,800 pounds could range from a value of $1,500.00 where fresh produce is being shipped to a value of $65,000.00 where human blood plasma is the commodity. In attempting to develop a reliable refrigerated cargo container, it is desirable to have a container where there are no moving parts or any otherwise mechanical devices, since all mechanical devices can and do break down at some time so that a passive system for the refrigerating cargo container is strongly preferred over some mechanical device.

With the need to develop a reliable refrigerated cargo container, there is also the need to develop a container which is safe for both the aircraft as well as the shipment. This safety factor is very important to aircraft personnel and crews since most aircraft personnel are hyper-sensitive about transporting any cargo that may present a threat to the safety of the aircraft or other cargoes being shipped. Because of certain aircraft regulations, an air cargo container usually cannot be connected to or draw power from an airline electric system without affecting the certification of the entire aircraft. Also, an air cargo container cannot emit any radio signals which might affect the aircraft's navigation system, thereby making electric motors and switches undesirable as being a part of the cargo container since they can emit signals, particularly when they malfunction. Also, as an additional safety feature in transporting cargo in aircraft, the refrigeration system cannot contain any gases at high pressures because of the danger of an explosion. As an added safety feature, a refrigerated container should only release carbon dioxide very slowly since high concentrations of carbon dioxide vapor could injure other living creatures such as pets/animals, which may also be carried in the same cargo compartment of the aircraft.

Perhaps an equally important factor as the reliability of a refrigerated cargo container is the cost of the container. The cost of the refrigerated container has to be kept fairly low in order to make the shipment of temperature-sensitive commodities by aircraft desirable. Costs of the refrigerated cargo containers should be limited to about 2–3 times the cost of a dry cargo container of the same size in order for it to be economical for use in shipping a broad range of temperature-sensitive commodities.

Certain prior art designs of refrigerated cargo containers have been attempted which have made use of exotic coolants or other exotic refrigeration mechanisms which have all resulted in increased operating and maintenance costs. There have been at least ten prior art designs for refrigerated air cargo containers over the past decade, but only four or five of these designs have been produced in any mentionable quantity, with only two of these designs being in use today.

It therefore follows that there is a need in the refrigeration container industry for a reliable container which can transport temperature-sensitive commodities within a temperature range which fluctuates by only at most 8° F. and usually within 4° F. from their desired temperatures, where the container is both safe to the cargo and to the aircraft carrying it and is also economical to the shipper. It is further desirable that this refrigerated container be such as to maximize the internal volume for storing cargo.

SUMMARY OF THE INVENTION

In view of the above outlined problems which still exist in the refrigerated container art, we have invented an air cargo refrigerated container which is equipped with means to maximize the removal of heat from the cargo and the container and to also maximize the amount of cool air which is circulated about the cargo and throughout the container. That is, we have invented a new and improved refrigerated air cargo container which has an insulated container housing with an insulated bunker for receiving a predetermined amount of coolant, usually solid carbon dioxide, preferably located along the top portion of the insulated container housing. The coolant bunker is further provided with a heat exchange portion, preferably located along the bottom portion of the bunker in a position such that warm air which rises to the top of the container is directed along an air inlet duct which is located along the top portion of the container, and is then cooled by the heat exchange portion of the bunker as the air passes over this area. Cool air passing from the heat exchange portion is then directed into the interior of the container through an output air duct located below the heat exchange area of the bunker and this air is circulated throughout the container and about the cargo being transported.

BRIEF DESCRIPTION OF THE DRAWINGS

The above and other advantages and characteristic features of the subject invention will become more apparent by reference to the following specifications and drawings in which reference will be made to the accompanying drawings wherein like reference numerals designate corresponding parts, and wherein.

DESCRIPTION OF THE PREFERRED EMBODIMENTS OF THE INVENTION

Figure 1:
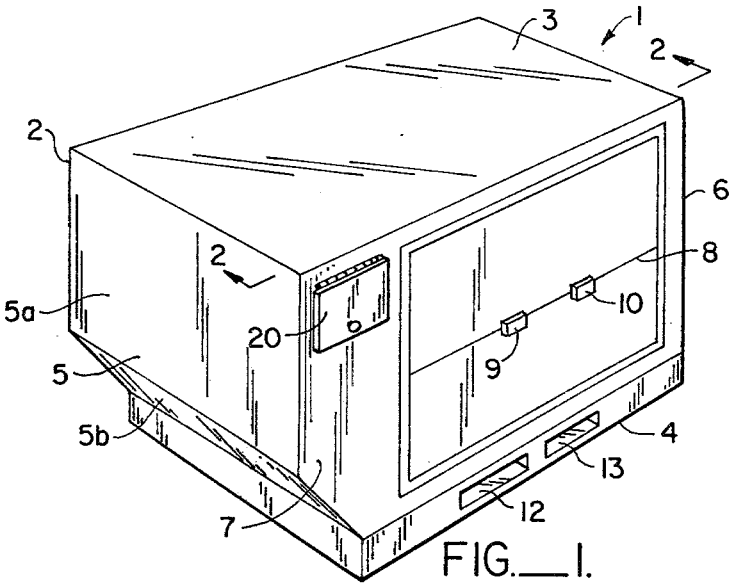
FIG. 1 illustrates a front perspective of a container constructed in accordance with the subject invention.

FIG. 1 illustrates a container housing 1 which has a back panel 2, a top panel 3, a bottom panel 4, two side panels 5, having portions 5*a* and 5*b*, and 6, and a front panel 7, across which is connected a door 8 with handles 9 and 10. Door 8 is releasably engageable with housing 1. Panels 2–7 are all insulated so that when door 8 is in its closed position relative to housing 1, housing 1 is substantially air-tight. The door 8 could be in any one of the four walls of the container housing. Container housing 1 may further be provided with fork lift pockets 12 and 13 for use in transporting container housing 1 to and from aircraft and other locations. A door 20 is located along front panel 7 of housing 1 to provide access to a bunker 25 (see description of FIG. 2) located within housing 1.

Figure 2:
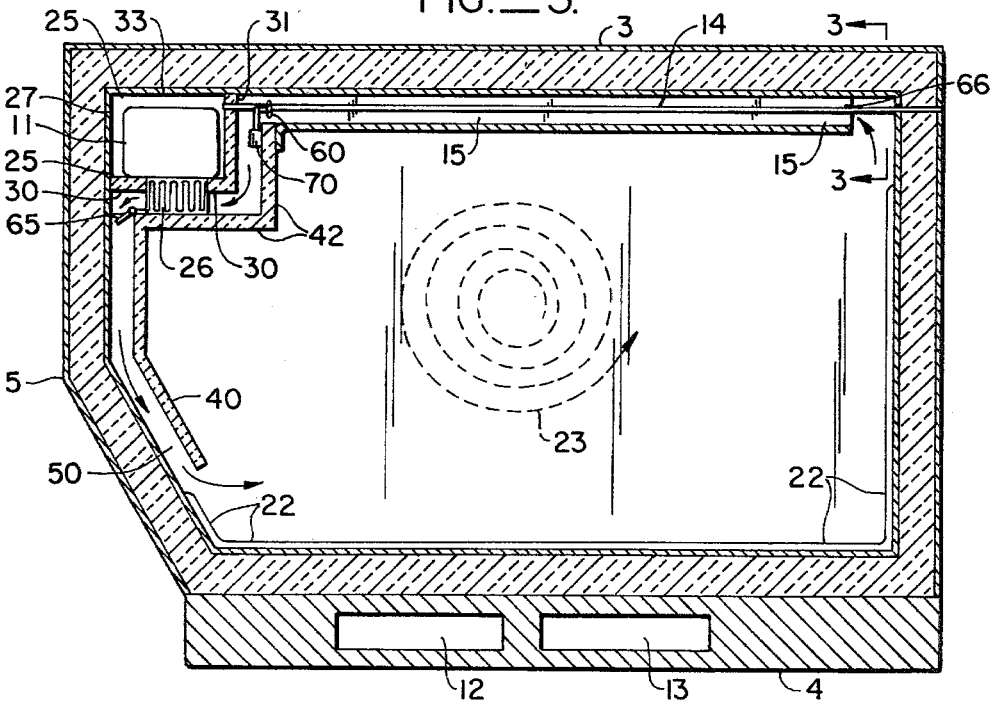
FIG. 2 illustrates a front inside view of the container taken along line 2—2 showing various of its component parts; and, FIG. 3 is a cross-sectional view of the top portion of the container taken along line 3—3 illustrating various component parts.

FIG. 2 illustrates the interior of housing 1 which is equipped with a bunker 25 for receiving a predetermined amount of coolant 11, usually solid carbon dioxide. Bunker 25 has walls 27, 28, 29, 30, 31 and 32 which are all insulated except that a portion of wall 30 has a heat exchange area 26. Heat exchange area 26 is a heat conductor in that it allows the warm air from the container's interior which is given off by the container interior and the cargo to exchange heat with a series of plates or baffles, usually made of metal, which in turn are in direct thermal contact with the coolant within the bunker 25 and so cause the coolant to sublime, vaporize or liquify. As the coolant sublimes, vaporizes or liquifies the heat exchanger or heat conductor is cooled and as warm air passes over this cooled heat exchanger that air is likewise cooled. In one embodiment of the invention, bunker walls 27, 28, 29 and 33 all coincide with a portion of container housing side panel 5, container housing back panel 2, container front panel 7 and container housing top panel 3. An insulated wall 42 is located along the side 31 and bottom 30 of bunker 25 and is slightly displaced a distance from the side wall 31 and bottom wall 30 of bunker 25. This wall protects any cargo which is in close proximity to bunker 25 from being damaged by the severely cold air being given off by heat exchanger 26.

An air duct 15 is located along housing top panel 3. Also, in one embodiment of the invention, two chimneys 14 and 16 (not shown) are located along the top of housing 1 extending along its top panel 3 between air duct 15 and panel 3. A curtain wall 40 is extended along housing side panel 5 and is displaced a distance from panel 5 to form an air duct 50 to allow cold air from heat exchanger 26 to pass through air duct 50 and into the interior of housing 1. Slats 22 are provided along housing panels 2, 4, 5, 6 and 7 to prevent cargo being transported in housing 1 from contacting the respective housing panels thereby preventing the cool air from duct 50 from circulating throughout the container and about the cargo being transported.

In one embodiment of the invention, a fan 60 may be installed along the air duct 15 to increase the flow of warm air from the interior of housing 1 through air duct 15 and to heat exchanger 26.

Figure 3:
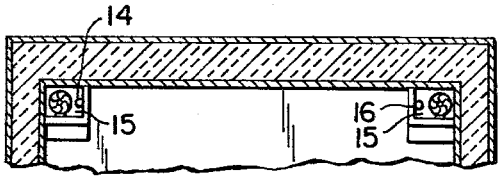

FIG. 3 illustrates a cross-sectional view of the top panel of housing 1 illustrating a section of air duct 15 and carbon dioxide chimneys 14 and 16.

When container housing 1 is used for transporting a temperature-sensitive commodity such as fresh produce or human blood plasma, a predetermined amount of coolant is placed in coolant bunker 25. Door 20 of bunker 25 and door 8 of housing 1 are in their closed positions providing for a substantially airtight bunker 25 and housing 1. Normally before any cargo is placed into housing 1, the cargo has been pre-cooled or frozen to its desired temperature. It is therefore the function of the cargo container 1 to maintain this cargo at its desired temperature. However, certain cargo may be living organisms which will contanue to respire during transit and, as such, will generate heat which must be overcome in order to maintain the organism at its desired transit temperature.

While in transit, any heat which penetrates the panel insulation into housing 1 or any heat generated by the cargo being transported in housing 1 will naturally rise to the top of housing 1 along housing panel 3 due to the natural convective flow of air in the container (indicated by the circular arrow 23 in FIG. 2). When this happens, air duct 15 will receive warm air which moves up along housing side panel 6 and towards top panel 3. The air moving through duct 15 will circulate toward bunker 25 and between baffle 40 and bunker 25 to contact heat exchanger 26. Heat exchanger 26 has been cooled by the coolant located within bunker 25 and has allowed heat from the interior of housing 1 to pass into bunker 25 and to cause the coolant to sublime, vaporize or liquify. The liquid or gaseous coolant then cools heat exchanger 26. As the warm air passes through duct 15 to contact heat exchanger 26, this air is cooled by heat exchanger 26. The cool air then continues along its path through air duct 50 and the cool air flows into the remaining interior of the container where it circulates throughout the container and about the cargo being transported. The driving force causing the air to circulate is the difference in density between the cold air descending through air duct 50 and the warm air rising through the body of the housing 1. With careful design this convective force can cause 10–30 cubic feet of air per minute to move through ducts 15 and 50.

Air duct 50 is preferably formed with an insulated curtain wall 40 being suspended along one of the housing side walls 5 as is illustrated. The insulated curtain 40 maximizes the length of the cold air column as it descends from the heat exchanger 26. Curtain wall 40 need not be insulated, however, by insulating the wall, it will maximize the length of the column of cold air leaving the heat exchanger and hence maximize the convective driving force which causes the cool air to circulate.

In one embodiment of the invention, a damper means 65 is located along the path of air duct 50 to control the amount of cool air leaving heat exchanger 26 and entering duct 50 to flow to the interior of housing 1. Damper 65 may be equipped to move between 1–5 positions to allow a variable amount of cool air to pass through duct 50 and into the interior of housing 1. Closing this damper slows the convective circulation and prolongs the life of one charge of coolant.

As cool air circulates among the cargo and the interior of housing 1, this air is warmed up by any heat given off by the cargoes, particularly when the cargo is living organisms which continues to respire, and by other warm air which is circulating about the housing interior. This warm air then rises to the top of housing 1 where it will again pass through inlet duct 15 and be directed toward heat exchanger 26 of bunker 25 where it is cooled. The cycle is a continuous one designed to maintain the cargo and the interior of housing 1 at a relatively uniform temperature. Door 20 of bunker 25 allows for bunker 25 to be replenished with coolant without the necessity of having to open door 8 of housing 1 which will result in breaking the airtight seal of housing 1 and door 8, thus allowing ambient heat to enter housing 1.

Fan 60, when in operation will increase or aid the convective flow of warm air through inlet duct 15. Fan 60 may be operated by a small motor 70 which may be actuated in response to a temperature difference between the coolant in bunker 25 and the cargo being transported. Fan 60 may also be actuated by a response to a predetermined temperature difference between the exterior of housing 1 and the coolant being carried in bunker 25. Or, fan 60 may be driven by a small motor which is actuated in response to a predetermined pressure from the subliming carbon dioxide or other gas given off by the coolant in bunker 25.

In one embodiment of the invention, one or more ducts or chimneys 14 and 16 are connected to bunker 25 and pass along top panel 3 of housing 1. Chimneys 14 and 16 are provided to allow the vapor from the coolant to escape from housing 1 along its top panel to the exterior of housing 1. Chimneys 14 and 16 may also be constructed to allow the chilled vapor from the subliming or vaporizing coolant to pass along the top of housing 1 and to be directed into the interior of housing 1. This may be desirable where fresh produce is the cargo being transported since increasing the proportions of carbon dioxide in the air within housing 1 serves to "put the cargo to sleep", i.e., to minimize the respiration of the cargo and, as such, to minimize the amount of heat given off by the cargo during transit. This prolongs the cargo's shelf life. However, if the cargo were living creatures, increasing the proportions of carbon dioxide could be fatal.

A radiator 66 may be provided near the end of chimney 14 (and 16 if desired) which is opposite the ends of chimney 14 and 16 which are connected to bunker 25. This radiator 66 will result in that portion of chimney 14 (and 16) becoming heated up by warm air which is circulating along side wall 6 of housing 1 and, as such, the warm air will become cooled by the chilled coolant vapor. This provides a way of utilizing the chilled coolant to the maximum extent before it exits housing 1. This is particularly desirable since the warmest of the air circulating in housing 1 will be circulating about housing side wall 6 since this wall is farthest away from coolant bunker 25. It is desirable that chimneys 14 and 16 be insulated for the greater portion of their respective lengths along top panel 3 to maintain the coolant vapor at a very cool temperature as it moves along top panel 3. However, radiator 66 will be located along a non-insulated portion of chimney 14 since at the location of the radiator, it would be necessary for warm air to be conducted through chimneys 14 and 16 and for cool air to be conducted to the exterior of chimneys 14 and 16 and into the interior of housing 1. Chimneys 14 and 16 may also be located within top panel 3 and, as such, will be insulated in the same manner that top panel 3 is insulated.

The invention has been described in detail with particular reference to certain embodiments thereof, but it will be understood that variations and modifications can be effected within the spirit and scope of the invention. For example, the coolant in bunker 25 may be any vaporizable coolant, such as wet ice, blue gel or liquid nitrogen. Also, door 8 of housing 1 may be located across any of housing panels 2–7, not just front panel 7. The chimney used to allow the vapor from the coolant to escape may be one or more than one in number.

What is claimed is:

1. A refrigerated cargo container comprising:

an insulated housing assembly having an insulated top panel, an insulated bottom panel, an insulated back panel, two respective insulated side panels, an insulated front panel with insulated door means releasably engageable across a portion of said front panel, all of said panels being sealably connected to each other and with sealing means cooperating between said door means and said housing assembly to make said housing assembly substantially air-tight when said door means is in the closed position relative to said housing assembly;

a bunker located in said housing assembly for receiving a predetermined amount of coolant, said bunker being substantially insulated to prolong the period during which the coolant sublimes, vaporizes or liquifies such that the time required for the coolant to change states approximately offsets the temperature increase in the housing assembly to maintain the cargo in the housing assembly at a substantially constant temperature, said bunker further having at least one heat exchange portion positioned to allow heat from said housing assembly to pass to said coolant such that said coolant sublimes, vaporizes or liquifies, cooling said heat exchange portion of said bunker;

an insulated baffle surrounding a portion of said bunker including said heat exchange portion of said bunker such that cargo located in said housing assembly in close proximity to said carbon dioxide bunker is protected from freezing temperatures;

an air inlet duct extending along and parallel to the top panel of said housing assembly to said bunker, from the side wall opposite to said bunker, said inlet duct being open to the interior of said housing only at a point adjacent to said opposite side wall, for directing warm air from the area along the side panel of said housing assembly opposite said bunker to the area around said bunker including said heat exchange portion of said bunker where the warm air from said housing assembly is cooled by said heat exchange portion;

a curtain wall extending from said baffle surrounding a portion of said bunker and continuing along one of said housing side panels below said bunker for a major part of the length of said panel forming an output air duct to allow cool air from said heat exchange portion of said bunker to pass through said output air duct to circulate through said housing interior; protruberances projecting from the interior surface of said side, back and bottom panels of said housing assembly to prevent cargo from directly contacting said panels such that cool air from said output duct will circulate along some of the recessed surfaces of said wall and throughout said housing assembly to maintain said cargo at a substantially constant temperature; and a chimney duct located along the top panel of said housing assembly between said inlet duct and said top panel and extending along said top panel for substantially the length of said top panel and having one of its two-end portions connected to said bunker to allow coolant vapor from said bunker to enter said chimney and to pass through said chimney exiting through the other end portion of said chimney as said coolant sublimes, liquifies or vaporizes, said chimney duct being insulated for the greater portion of its length along said top housing panel with a non-insulated portion located near the opening of said inlet duct near the side panel opposite said bunker;

2. A refrigerated cargo container of the type described in claim 1 wherein said non-insulated portion of said chimney duct further comprises radiator means such that heat from the air circulating about the side panel of said housing assembly near said radiator is transferred to the coolant vapor passing through said duct to increase the temperature of said coolant vapor and decrease the temperature of said air circulating about said side panel.

3. A refrigerated cargo container of the type described in claim 1 wherein said non-insulated portion of said chimney duct is directed into the interior of said housing assembly to allow the coolant vapor from said bunker to circulate within the interior of said housing assembly as said coolant sublimes or vaporizes.

4. A refrigerated cargo container of the type described in claim 1 wherein said chimney duct is located within said insulated top housing panel.

5. A refrigerated cargo container of the type described in claim 4 wherein said chimney duct extends along the top panel of said housing and further extends to the exterior of said housing to allow coolant vapor from said bunker to pass to the exterior of said housing assembly as said coolant sublimes or vaporizes.

6. A refrigerated cargo container of the type described in claim 1 wherein said air inlet duct has a motor-driven fan located along its path proximate said bunker to increase the flow of warm air passing through said inlet duct to said heat exchange portion of said bunker with said fan motor being operatively connected to a thermo-electric generator to energize said fan in response to a predetermined temperature difference between the interior of said housing assembly and said coolant bunker.

7. A refrigerated cargo container of the type described in claim 1 wherein said air inlet duct has a motor-driven fan located along its path proximate said bunker to increase the flow of warm air passing through said inlet duct to said heat exchange portion of said bunker with said fan motor being operatively connected to a thermo-electric generator to energize said fan in response to a predetermined temperature difference between the exterior of said housing assembly and said coolant bunker.

* * * * *